US007824225B1

(12) United States Patent
Wang

(10) Patent No.: US 7,824,225 B1
(45) Date of Patent: Nov. 2, 2010

(54) ELECTRICAL CONNECTOR HAVING TERMINALS INSERT MOLDED TO A BASE BOARD

(75) Inventor: Chin-Chou Wang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/482,453

(22) Filed: Jun. 11, 2009

(51) Int. Cl.
*H01R 24/00* (2006.01)

(52) U.S. Cl. ..... 439/630; 439/736

(58) Field of Classification Search ..... 439/752, 439/630, 159, 862, 941, 736; 29/827, 883, 29/884

See application file for complete search history.

(56) References Cited

U.S. PATENT DOCUMENTS 6,951,470 B1 * 10/2005 Huang ..... 439/159
7,086,904 B1 * 8/2006 Kuan et al. ..... 439/630
7,494,381 B1 * 2/2009 Wu et al. ..... 439/630
7,540,782 B2 * 6/2009 Takahashi et al. ..... 439/630
7,635,276 B1 * 12/2009 Chu et al. ..... 439/326
7,651,338 B2 * 1/2010 Miyamoto et al. ..... 439/66

* cited by examiner

*Primary Examiner*—Michael C Zarroli

(57) ABSTRACT

An electrical connector includes an insulating body and a row of terminals formed by cutting a metal sheet. The insulating body has a base board defining a row of terminal cavities. Each of the terminal cavities includes a fixing cavity. A plurality of exit cavities each is formed between two adjacent fixing cavities. The terminals are insert molded to the base board and have respective plate-shaped fixed portions spaced from each other. Each adjacent two fixed portions have two pairs of inner connecting arms protruded from the fixed portions towards each other and spaced with each other. The fixed portions and the inner connecting arms are embedded in the corresponding fixing cavities. Each adjacent two pairs of the inner connecting arms are formed by cutting out a middle part of an inner connecting portion which connects corresponding portions of each adjacent two fixed portions from the corresponding exit cavity.

14 Claims, 6 Drawing Sheets

ELECTRICAL CONNECTOR HAVING TERMINALS INSERT MOLDED TO A BASE BOARD

BACKGROUND OF THE INVENTION

1. Field of the Invention

The present invention generally relates to an electrical connector, and more particularly to an electrical connector capable of assembling terminals thereof quickly and ensuring certain relative locations of the terminals.

2. The Related Art

A conventional electrical connector includes an insulating body, a plurality of terminals disposed in the insulating body, and a shell covering the insulating body. The insulating body has a base board which defines a plurality of terminal cavities arranged in rows. Each of the terminals has a fixed portion, a soldering portion and a contacting arm extending from two opposite ends of the fixed portion. However, because the terminals are disposed individually, the assembly of the terminals needs a relative long time and results in uncertain relative locations of the terminals in the insulating body.

SUMMARY OF THE INVENTION

It is an object of the present invention to provide an electrical connector including an insulating body and a row of terminals formed by cutting a metal sheet. The insulating body has a base board. The base board has a row of terminal cavities. Each of the terminal cavities includes a plate-shaped fixing cavity formed inside the base board. A plurality of exit cavities each is formed between two adjacent fixing cavities for connecting the two fixing cavities. The terminals are insert molded to the base board. Each of the terminals has a respective plate-shaped fixed portion spaced from each other. Each adjacent two fixed portions have two pairs of inner connecting arms protruded from the fixed portions towards each other and spaced with each other with a small distance. The fixed portions and the inner connecting arms are embedded in the corresponding fixing cavities. Each adjacent two pairs of inner connecting arms are formed by cutting out a middle part of an inner connecting portion which connects corresponding portions of each adjacent two fixed portions from the corresponding exit cavity.

As described above, the row of terminals is formed by cutting a metal sheet, with a plurality of inner connecting portions connecting the adjacent terminals to form a single piece and then insert molded to the base board. Then, the middles of inner connecting portions are cut out from the corresponding exit cavities formed in the base board to separate the terminals from each other. Therefore, the terminals can be placed in the insulating body together, and the assembly of the terminals needs a relative short time and results in certain relative locations of the terminals in the insulating body.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
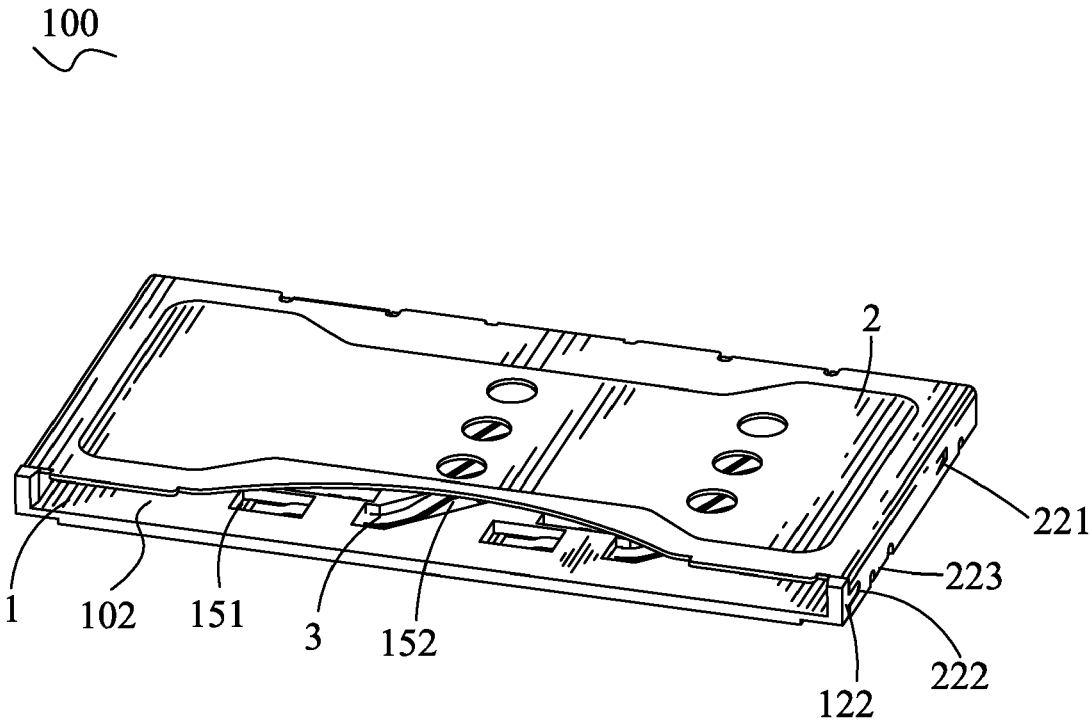
FIG. 1 is a perspective view of an electrical connector in accordance with the present invention.
Figure 2:
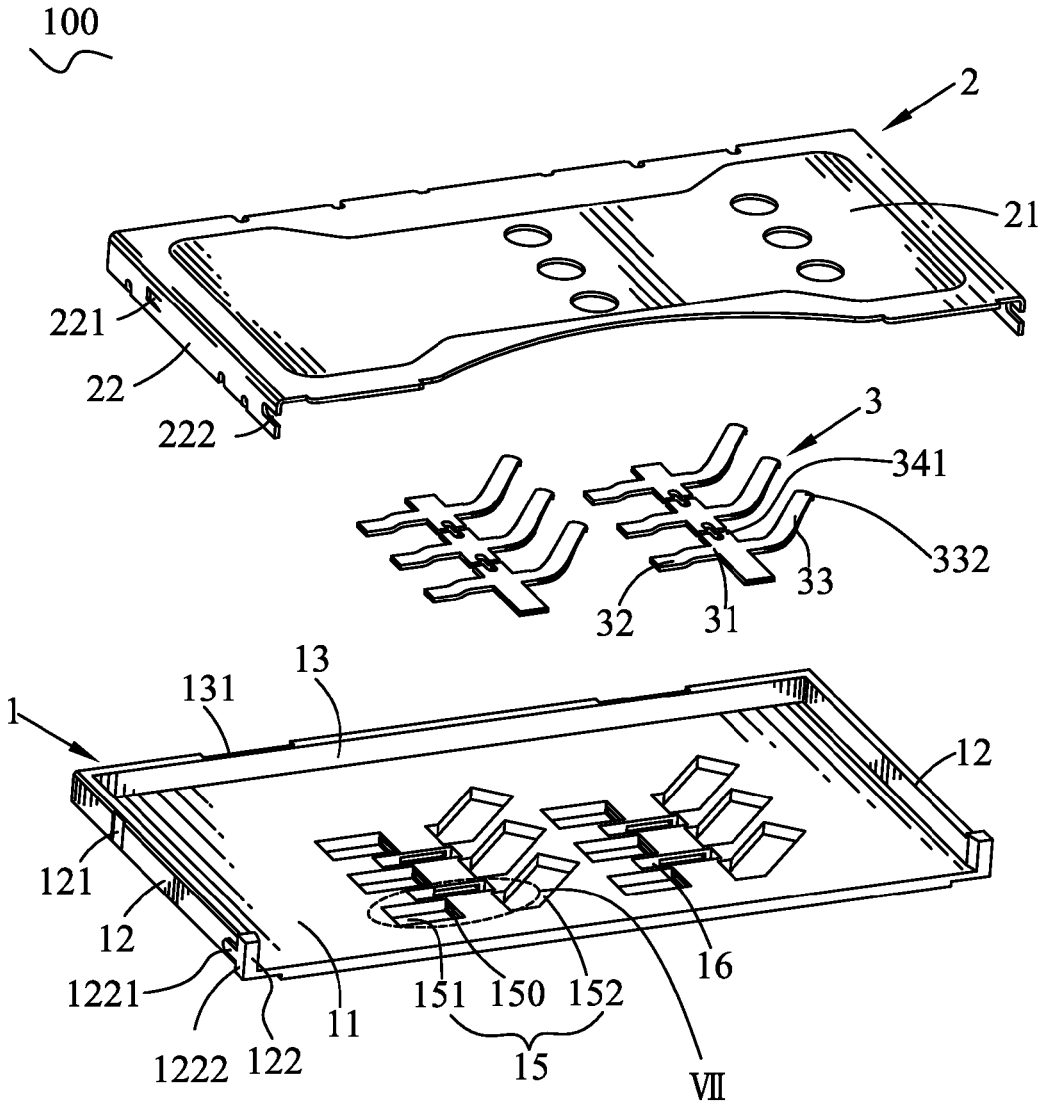
FIG. 2 is an exploded perspective view of the electrical connector.

Referring to FIGS. 1-2, an electrical connector 100 according to the present invention includes an insulating body 1, a plurality of terminals 3 integrated in the insulating body 1, and a shell 2 covering the insulating body 1.

Figure 7:
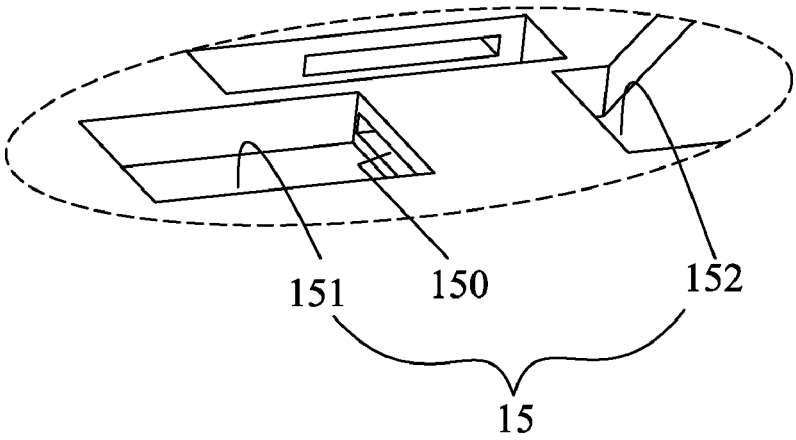
FIG. 7 is an enlarged view of an encircled portion A of the insulating body of the electrical connector of FIG. 2.
Figure 8:
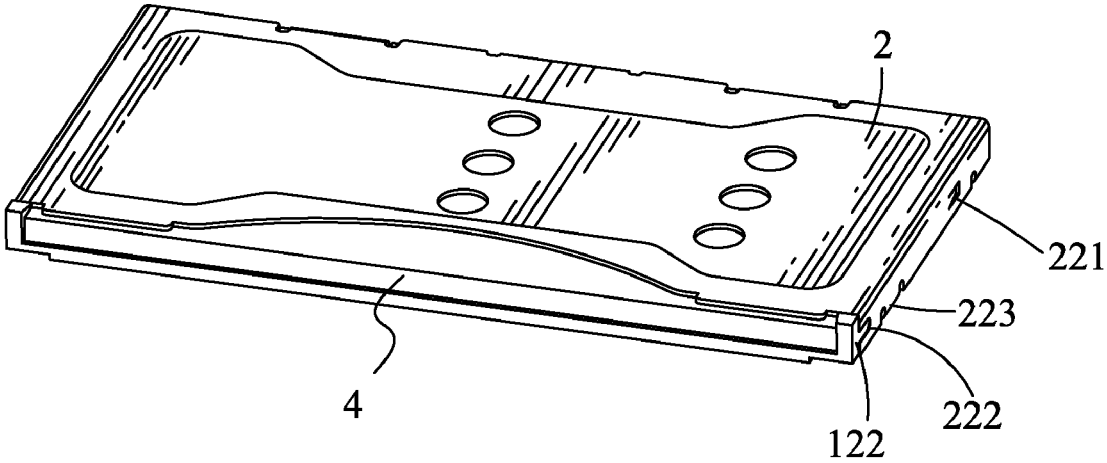
FIG. 8 is a perspective view showing a card being inserted in the electrical connector.

Referring to FIG. 2 and FIG. 7, the insulating body 1 has a base board 11, two longitudinal side walls 12 extended upward from two opposing sides of the base board 11, and a transverse rear wall 13 extended upward from a rear of the base board 11. The base board 11 defines a plurality of terminal cavities 15 which are arranged in two longitudinal rows. Each of terminal cavities 15 includes a plate-shaped fixing cavity 150 extending transversely and formed inside the base board 11, a soldering cavity 151 extending transversely to connect with one end of the fixing cavity 150 and penetrating a top and a bottom of the base board 11, and a retreating cavity 152 extending transversely from the other end of the fixing cavity 150 and then extending inclingly rearward to form an obtuse angled corner and penetrating the top and the bottom of the base board 11. A plurality of exit cavities 16 each is formed between two adjacent fixing cavities 150 for connecting the two fixing cavities 150. Each of the side walls 12 defines a notch 121 at a rear portion thereof and a lying-T shaped fixing block 122 protruded outwards at a front end thereof. The fixing block 122 includes a level extending portion 1221 facing the rear and a vertical extending portion 1222. The rear wall 13 defines two buckling recesses 131 spaced from each other.

Figure 3:
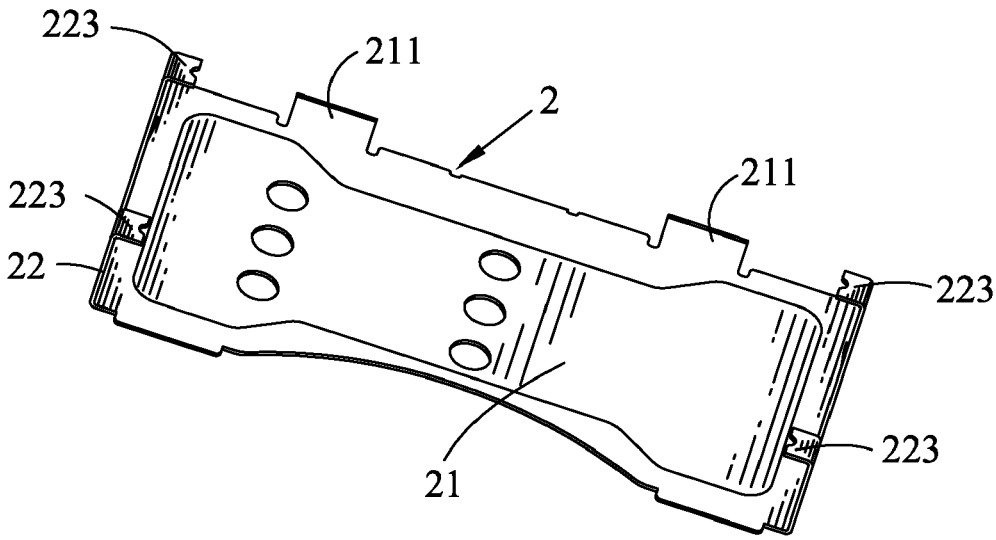
FIG. 3 is perspective view of a shell of the electrical connector.

Referring to FIG. 2 and FIG. 3, the shell 2 has a top plate 21, a rear edge of the top plate 21 extending downward to form two spaced buckling pieces 211. Two side plates 22 are extended downward from two opposing sides of the top plate 21. Each of the side plates 22 is punched inward to form a propping piece 221 with a rear free end at a rear portion thereof and opened a gap 222 at a front end thereof. A bottom of the side plates 22 extends inward to form two spaced tabs 223.

Figure 4:
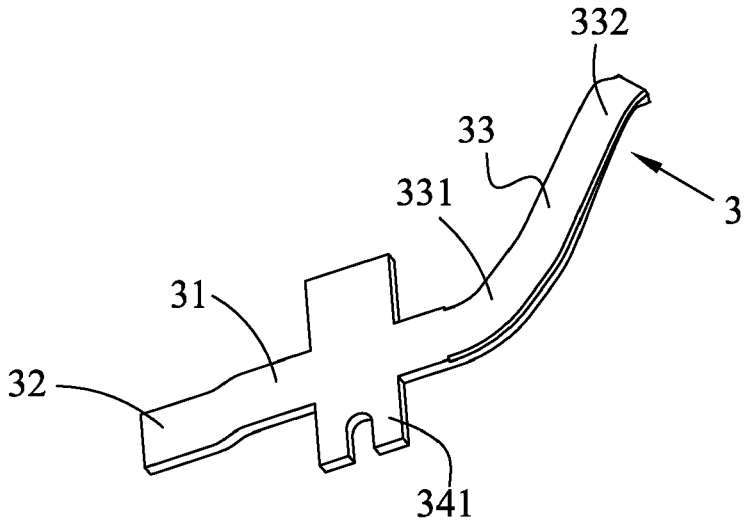
FIG. 4 is a perspective view of a terminal of the electrical connector.

Referring to FIG. 2 and FIG. 4, each of the terminals 3 has a narrow plate-shaped fixed portion 31 extending transversely, a soldering portion 32 extending transversely from one end of the fixed portion 31, and a contacting arm 33 extending from the other end of the fixed portion 31. The contacting arm 33 includes an extending portion 331 extending transversely and then curved rearward to define a mild arc-shaped corner from the other end of the fixed portion 31. A free end of the extending portion 331 is curved upward and then extended inclingly to form a contacting portion 332 with a distal end thereof curved downward.

Figure 5:
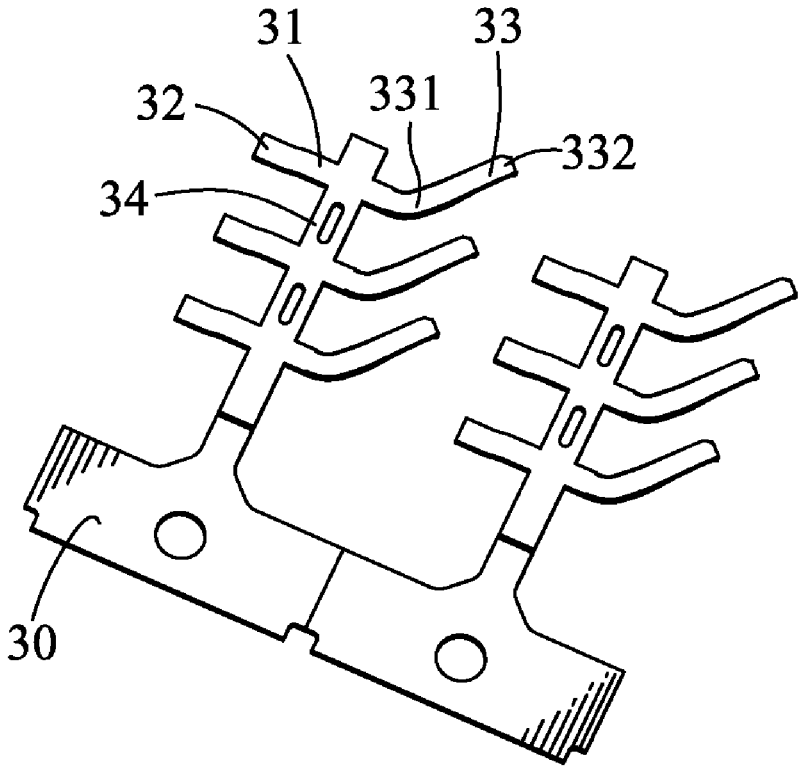
FIG. 5 is a perspective view showing the terminals of the electrical connector being connected in a singe piece by a rim connecting portion and a plurality of inner connecting portions.

Referring to FIG. 2 and FIG. 5, each row of the terminals 3 is formed by cutting a metal sheet, with a rim connecting portion 30 and a plurality of inner connecting portions 34 formed in a single piece. Each of the inner connecting portions 34 is connected between substantially middle portions of the corresponding two adjacent fixed portions 31. The rim connecting portion 30 connects to a substantially middle portion of the forefront fixed portion 31. In this case, the two rows of the terminals 3 are formed by cutting a metal sheet to share the common rim connecting portion 30.

Figure 6:
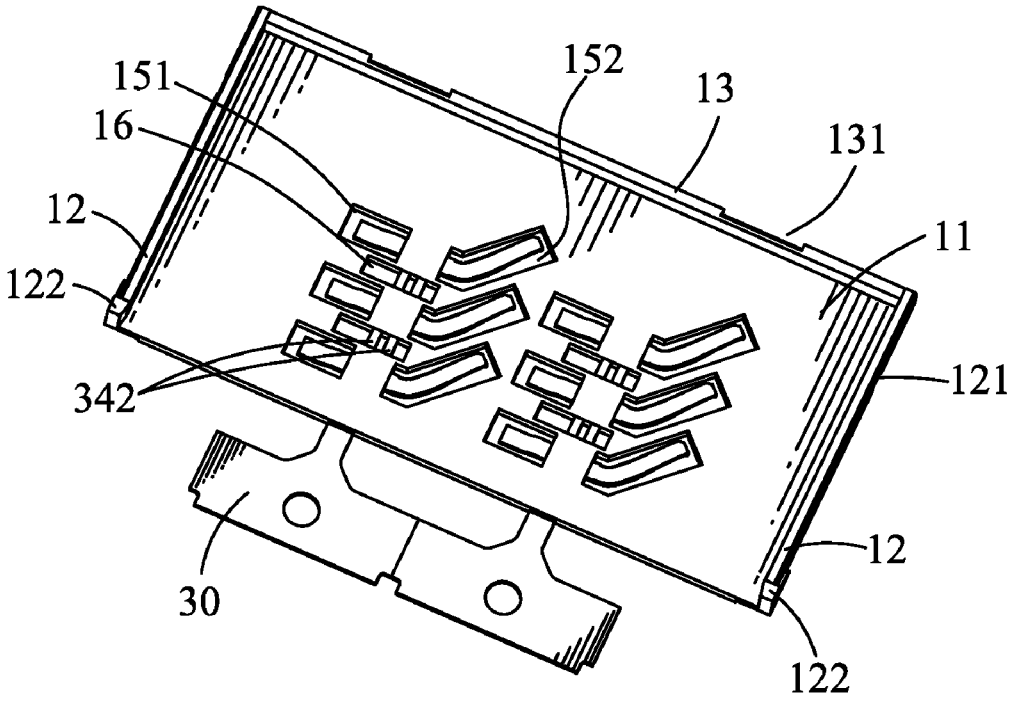
FIG. 6 is a perspective view showing the single piece of FIG. 5 being insert molded to an insulating body of the electrical connector with the rim connecting portion located outside the insulating body.

Referring to FIG. 2 and FIG. 6, the terminals 3 are integrated with the insulating body 1 by insert molding, with the fixed portions 31 and two sides of the inner connecting portions 34 are embedded in the corresponding fixing cavities 150, middles of the inner connecting portions 34 are positioned in the corresponding exit cavities 16. The soldering portions 32 are located in the corresponding soldering cavities 151 for being soldered to a printed circuit board (not shown) under the insulating body 1. The extending portions 331 are located in the corresponding retreating cavities 152 and the contacting portions 332 extend beyond the top of the base board 11. After the terminals 3 are integrated with the insulating body 1 by insert molding, the rim connecting portion 30 is removed from the terminals 3, the middle part 342 of each of the inner connecting portions 34 is cut out from the corresponding exit cavity 16 to form two pairs of inner connecting arms 341 connected to the respective fixed portions 31 and embedded in the corresponding fixing cavities 150.

Referring to FIGS. 1-3, and FIG. 8, the shell 2 is slid from rear to front for covering the insulating body 1. When the engagement of the shell 2 and the insulating body 1 is finished, the level extending portion 1221 of the T-shaped fixing block 122 is engaged in the gap 222 of the corresponding side plate 22, the vertical extending portion 1222 is against a front edge of the corresponding side plate 22, the propping piece 221 is located in the corresponding notch 121, the tabs 223 are buckled to the bottom of the base board 11, the buckling pieces 211 are buckled to the rear wall 13, therefore, a firm engagement of the shell 2 and the insulating body 1 is ensured. The shell 2 and the insulating body 1 define a receiving space 102 therebetween for receiving a card 4 which is inserted from a front of the insulating body 1. When the card 4 is inserted into the receiving space 102, the contacting portions 332 are electrically contacted with the card 4 and pressed downward to retreat to the corresponding retreating cavities 152. Moreover, due to the characteristic shape and the location in the insulating body 1 of the contacting arm 33, the card 4 can be inserted into the receiving space 102 smoothly without an interference occurring between the card 4 and the contacting arms 33.

As described above, the terminals 3 are formed by cutting a metal sheet, with a rim connecting portion 30 and a plurality of inner connecting portions 34 connecting the terminals 3 to form a single piece and then insert molded to the base board 11. Then, the rim connecting portion 30 is removed from the terminals 3 and the middles of inner connecting portions 34 are cut out from the corresponding exit cavities 16 formed in the base board 11 to separate the terminals 3 from each other. Therefore, the terminals 3 can be placed in the insulating body 1 together, the assembly of the terminals 3 needs a relative short time and results in a certain relative locations of the terminals 3 in the insulating body 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

an insulating body having a base board, the base board having a row of terminal cavities, each of the terminal cavities including a plate-shaped fixing cavity formed inside the base board, a plurality of exit cavities each being formed between two adjacent fixing cavities for connecting the two fixing cavities; and a row of terminals formed by cutting a metal sheet and the terminals being insert molded to the base board, the terminals having respective plate-shaped fixed portions spaced from each other, each adjacent two fixed portions having two pairs of inner connecting arms in between with each pair being protruded from one fixed portion towards the other fixed portion with a small distance between the two pairs, the fixed portions and the inner connecting arms being embedded in the corresponding fixing cavities, wherein each adjacent two pairs of inner connecting arms are formed by cutting out a middle part of an inner connecting portion which connects corresponding portions of each adjacent two fixed portions from the corresponding exit cavity.

2. The electrical connector as claimed in claim 1, wherein the row where the terminals cavities are arrayed is front-to-rear, and a receiving space is formed over the base board for receiving a card which is inserted into the receiving space from front to rear.

3. The electrical connector as claimed in claim 2, wherein each of the fixed portions extends transversely, a contacting arm extends from one end of the fixed portion, the contacting arm includes an extending portion extending transversely and then curved rearward to define a mild arc-shaped corner from the one end of the fixed portion, and a free end of the extending portion is curved upward and then extended inclingly to form a contacting portion.

4. The electrical connector as claimed in claim 3, wherein the contacting portion has a distal end curved downward.

5. The electrical connector as claimed in claim 3, wherein each of the fixing cavities extends along a transverse direction perpendicular to a front-to-rear direction, and each of the terminal cavities further includes a retreating cavity extending transversely from one end of the fixing cavity and then extending inclingly rearward to form an obtuse angled corner and penetrating a top of the base board for receiving the extending portion and allowing the contacting portion to retreat thereinto from the receiving space when the card is inserted in the receiving space.

6. The electrical connector as claimed in claim 5, wherein each of the terminal cavities further includes a soldering cavity extending transversely to connect with the other end of the fixing cavity and penetrating a bottom of the base board for receiving a soldering portion which extends transversely from the other end of the fixed portion.

7. The electrical connector as claimed in claim 6, wherein the soldering cavity and the retreating cavity penetrate both the top and the bottom of the base board.

8. The electrical connector as claimed in claim 1, wherein a portion of an outmost fixed portion is connected to a rim connecting portion which is removed after the terminals are insert molded to the insulating body.

9. The electrical connector as claimed in claim 8, wherein the terminals are divided into two side by side rows by cutting the metal sheet to share a common rim connecting portion.

10. The electrical connector as claimed in claim 1, further comprising a shell with a top plate and two opposing side plates extending downward from the top plate, two opposing sides and a rear of the base board extending upward to form two side walls and a rear wall, respectively, the shell covering the insulating body to define a receiving space therebetween.

11. The electrical connector as claimed in claim 10, wherein the side wall defines a lying-T shaped fixing block protruded outwards at a front end thereof, the fixing block includes a vertical extending portion and a level extending portion facing the rear, a front end of the side plate defines a gap for engaging with the level extending portion, and the vertical extending portion is against a front edge of the side plate.

12. The electrical connector as claimed in claim 11, wherein the side wall defines a notch at a rear portion thereof, and a rear portion of the side plate is punched inward to form a propping piece with a rear free end for being located in the notch.

13. The electrical connector as claimed in claim 11, wherein a bottom of the side plate extends inward to form a tab buckled to a bottom of the base board.

14. The electrical connector as claimed in claim 11, wherein a rear edge of the top plate extends downward to form a buckling piece buckled to the rear wall.

* * * * *